US006771226B1

(12) United States Patent
Dujmovic

(10) Patent No.: US 6,771,226 B1
(45) Date of Patent: Aug. 3, 2004

(54) THREE-DIMENSIONAL WIDEBAND ANTENNA

(75) Inventor: Richard M. Dujmovic, Prospect Heights, IL (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/338,070

(22) Filed: Jan. 7, 2003

(51) Int. Cl.[7] ..... H01Q 21/26
(52) U.S. Cl. ..... 343/797; 343/786
(58) Field of Search ..... 343/772, 786, 343/797, 798, 799, 785

(56) References Cited

U.S. PATENT DOCUMENTS 2,581,352 A * 1/1952 Roderic ..... 343/795
3,273,158 A * 9/1966 Fouts et al. ..... 343/792
3,811,127 A * 5/1974 Griffee et al. ..... 343/705
4,843,403 A 6/1989 Lalezari et al. ..... 343/767
5,278,575 A 1/1994 Thomas ..... 343/795
5,428,364 A 6/1995 Lee et al. ..... 343/767
5,557,291 A 9/1996 Chu et al. ..... 343/725
5,568,159 A 10/1996 Pelton et al. ..... 343/767
5,748,152 A 5/1998 Glabe et al. ..... 343/767
5,748,153 A 5/1998 McKinzie, III et al. .... 343/767
5,894,288 A 4/1999 Lee et al. ..... 343/770

* cited by examiner

*Primary Examiner*—Hoang V. Nguyen
(74) *Attorney, Agent, or Firm*—Fulbright & Jaworski LLP

(57) ABSTRACT

An antenna operable to radiate electromagnetic waves in a three-dimensional radiation field pattern is provided. The antenna includes one or more radiators, each including one or more radiating elements having a three-dimensional shape. The three-dimensional shape of each radiating element varies in each of the three dimensions.

29 Claims, 2 Drawing Sheets

THREE-DIMENSIONAL WIDEBAND ANTENNA

TECHNICAL FIELD OF THE INVENTION

This invention relates in general to antennas and, more particularly, to three-dimensional wideband antennas.

BACKGROUND OF THE INVENTION

Broadband or wideband radiators or antennas are used in many applications, including various radar, navigation, and weather applications, for example. A particular class of wideband antenna, the tapered-element antenna, has become increasingly popular for use on aircraft for various radar applications. Tapered element antennas include flared notch or Vivaldi radiators, which typically include a pair of relatively large and relatively planar conductors, or radiating elements, operable to radiate electromagnetic signals into the atmosphere. The radiating elements are separated by a gap that is relatively narrow and substantially parallel near one end (the input end) of the radiating elements, and that gradually increases in width as the radiating elements curve away from each other toward the other end (the flared end) of the radiating elements.

To transmit electromagnetic signals from a flared notch or Vivaldi radiator, RF power is applied from a "balanced-"source connected to the input end of each radiating element by a separate lead, such as by the leads of a coaxial cable used with a balun, for example. As the electromagnetic energy propagates along the narrow portion of the gap between the radiating elements, there is little or no radiation due to the cancellation of electromagnetic energy caused by counter-phasing of the parallel or near-parallel electromagnetic field within the gap. As the electromagnetic energy propagates toward the flared portions of the radiating elements, the transverse components of the electromagnetic field within the gap become additive (in other words, in phase) and as a result, an electromagnetic field is radiated outwardly from the wide portion of the gap.

Generally, the radiation field pattern generated from and/or received by a traditional, planar flared notch or Vivaldi radiator is linearly polarized. For example, if a flared notch radiator is positioned to lie in the horizontal plane, the radiation field pattern associated with the radiator is said to be horizontally polarized. In addition, the radiation field pattern generated from and/or received by a traditional two-dimensional, planar flared notch or Vivaldi radiator may be relatively well defined relative to certain "principal planes." One such principal plane is the plane in which the radiator lies, commonly referred to as the "E-plane." The radiation field pattern may, to some limited extent, be controlled in the principal planes by selecting or adjusting the planar dimensions of the radiating elements comprising the radiator.

SUMMARY OF THE INVENTION

The present invention provides a three-dimensional wideband antenna having one or more three-dimensional antenna elements. The radiation field pattern generated by the antenna may be substantially controlled in both principal planes, the E-plane and the H-plane, based on the three-dimensional shape of the antenna elements.

According to one embodiment, an antenna operable to radiate electromagnetic waves in a three-dimensional radiation field pattern is provided. The antenna includes one or more radiators, each including one or more radiating elements having a three-dimensional shape. The three-dimensional shape of each radiating element varies in each of the three standard orthogonal coordinate dimensions.

According to another embodiment, a method of producing a three-dimensional radiation field pattern is provided. The method includes radiating electromagnetic waves from an antenna comprising one or more radiators, each including one or more radiating elements having a three-dimensional shape. The three-dimensional shape of each radiating element varies in each of the three standard orthogonal coordinate dimensions.

According to yet another embodiment, a method of designing an antenna is provided. The method includes generating, using computer aided design software, a model antenna comprising one or more radiators. Each radiator comprises one or more radiating elements, each having a three-dimensional shape. The method further includes determining, using computer aided design software, the three-dimensional radiation field pattern associated with the model antenna. The shape of the three-dimensional radiation field pattern is defined at least in part by the three-dimensional shape of each of the radiating elements. The method further includes determining whether the three-dimensional radiation field pattern associated with the model antenna is satisfactory. The method further includes adjusting the three-dimensional shape of at least one of the one or more radiating elements if the three-dimensional radiation field pattern associated with the model antenna is not satisfactory.

Various embodiments of the present invention may benefit from numerous advantages. It should be noted that one or more embodiments may benefit from some, none, or all of the advantages discussed below.

One advantage of the invention is that a three-dimensional antenna may be provided that has a radiation field pattern that may be substantially controlled in all three dimensions based on the shape, dimensions and configuration of the antenna or the antenna's components (such as radiating elements, for example) in all three dimensions. This may result in a stronger or more focussed electromagnetic field as compared to electromagnetic fields produced by traditional two-dimensional antennas, particularly in the direction or plane (commonly referred to as the "H-plane") orthogonal to the plane in which the antenna (or each radiator of the antenna) generally lies (commonly referred to as the "E-plane"). Thus, less power may be required using such a three-dimensional antenna to produce a radiation field pattern having particular field strengths over particular spatial volumes than would be required using a traditional two-dimensional antenna. As a result, input energy to the antenna may be spatially concentrated, which may be particularly beneficial in limited power applications, such as onboard a manned or unmanned aircraft, for example.

Another advantage of the invention is that the antenna or the antenna's components (such as radiating elements, for example) may be modeled using computer aided design (CAD) software and simulated using electromagnetic software to determine the radiation field pattern associated with such antennas or antenna components. Thus, a radiation field pattern having a desired pattern or one or more particular parameters may be achieved by selecting and adjusting the shape, dimensions and configuration of an antenna or antenna component using such CAD software. In addition, the antenna and/or antenna components may be manufactured or constructed using fully or at least partially automated systems or methods. For example, CAD software may be used to generate instructions for manufacturing antennas or antenna components according to models generated as described above, and such instructions may be used by automated or at least partially automated manufacturing devices to physically manufacture or construct the antennas or antenna components.

Other advantages will be readily apparent to one having ordinary skill in the art from the following figures, descriptions, and claims.

BRIEF DESCRIPTION OF THE DRAWINGS

For a more complete understanding of the present invention and for further features and advantages, reference is now made to the following description, taken in conjunction with the accompanying drawings, in which.

DETAILED DESCRIPTION OF THE DRAWINGS

Figure 1:
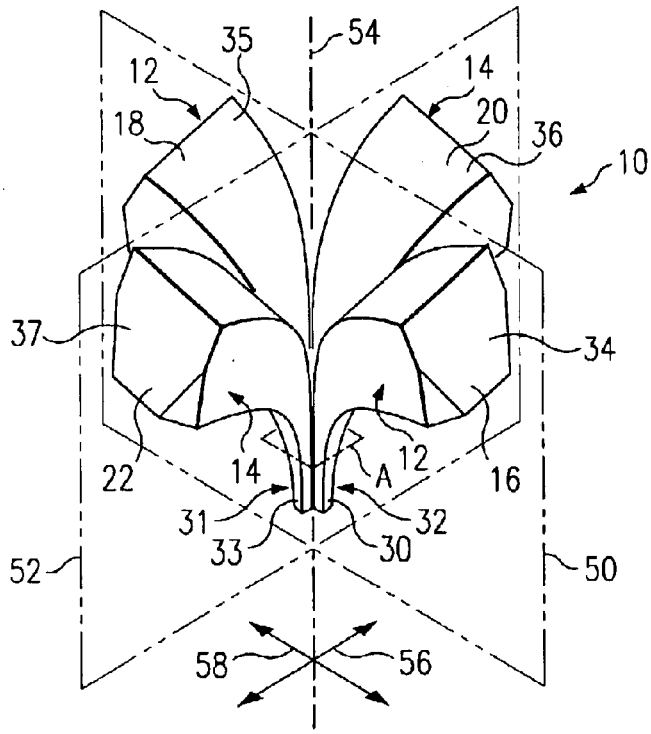
FIG. 1 illustrates an example three-dimensional wideband antenna operable to radiate electromagnetic signals in a controlled three-dimensional pattern in accordance with an embodiment of the present invention.

In general, a three-dimensional wideband antenna is provided for transmitting circular polarized signals and controlling the radiation field pattern of the antenna in all three dimensions. FIG. 1 illustrates an example three-dimensional wideband antenna 10 operable to radiate electromagnetic signals in a three-dimensional pattern. Antenna 10 includes a first radiator 12 and second radiator 14. First radiator 12 includes a first radiating element 16 and a second radiating element 18, and second radiator 14 includes a third radiating element 22 and a fourth radiating element 24. First radiating element 16 comprises a first (or input) end 30 and a second end 34 and second radiating element 18 comprises a first (or input) end 31 and a second end 35. Similarly, third radiating element 20 comprises a first (or input) end 32 and a second end 36 and fourth radiating element 22 comprises a first (or input) end 33 and a second end 37.

Each radiator 12 and 14 has a cross-section at least somewhat similar to a traditional planar or two-dimensional dipole flared notch radiator, but additionally includes a variable thickness in the direction orthogonal to such cross-section. For example, radiator 12 has a cross-section taken through a first plane 50 (which represents the E-plane of radiator 12 and the H-plane of radiator 14) that is similar to that of a traditional planar or two-dimensional dipole flared notch radiator taken through the E-plane of such traditional radiator, but has a variable thickness in the direction indicated by arrow 56 orthogonal to plane 50. Similarly, radiator 14 has a cross-section taken through a second plane 52 (which represents the E-plane of radiator 14 and the H-plane of radiator 12) orthogonal to first plane 50 that is similar to a traditional planar or two-dimensional dipole flared notch radiator, but has a variable thickness in the direction indicated by arrow 58 orthogonal to plane 52.

As discussed below in more detail, the shape of the three-dimensional radiation field pattern (for example, the radiation field pattern in both the E-plane and H-plane) that may be generated by antenna 10 is defined at least in part by the three-dimensional shape of each radiating element 16, 18, 20 and 22.

The term "three-dimensional shape" as used throughout this document refers to any shape that varies in shape in all three dimensions.

Antenna 10 is a dual-polarized antenna in which radiators 12 and 14 each produce a separate polarization. In particular embodiments, dual-polarization may be achieved by feeding signals to radiators 12 and 14 via a separate coaxial cable and balun coupled to each radiator 12 and 14. In one embodiment, each lead of a first coaxial feed is coupled to each radiating element 16 and 18 of radiator 12 near input end 30 of radiating element 16 and input end 31 of radiating element 18, and each lead of a second coaxial cable and balun is coupled to each radiating element 20 and 22 of radiator 14 near a input end 32 of radiating element 20 and input end 33 of radiating element 22. Thus, input ends 30, 31, 32 and 33 of radiating element 16, 18, 20 and 22 (or at least the conductive portions of input ends 30, 31, 32 and 33) may be physically separate from each other to avoid shorting the signals being communicated through radiating element 16, 18, 20 and 22.

Antenna 10 may be operable to transmit and/or receive circular polarized signals. In other words, a target antenna receiving signals transmitted from antenna 10 will have a substantially constant response regardless of the rotational orientation of antenna 10 around axis 54. For example, antenna 10 may be operable to transmit circular polarized signals if signals that are ninety degrees out-of-phase with each other are supplied to radiators 12 and 14.

In the embodiment shown in FIG. 1, radiators 12 and 14 are disposed about common axis 54 and orthogonal to each other such that antenna 10 includes a pair of dual-polarized radiators positioned orthogonal to each other. In alternative embodiments, antenna 10 includes radiators 12 and 14 are disposed about axis 54 at various angles to each other. In other embodiments, antenna 10 may include any number of radiators, which may or may not be similar to radiators 12 and 14.

The radiation field pattern produced by antenna 10 may be substantially controlled in all three dimensions by selecting the three-dimensional shape, volume, dimensions, and configuration of each radiating element 16, 18, 20 and 22. Thus, the radiation field pattern of antenna 10 may be controlled in all three dimensions, which results in a stronger or more focussed electromagnetic field produced from a particular input power as compared to traditional two-dimensional antennas. Antenna 10, radiators 12 and 14, and/or radiating elements 16, 18, 20 and 22 may be modeled or simulated using computer aided design (CAD) software to determine the resultant radiation field patterns. In addition, the antenna 10, radiators 12 and 14, and/or radiating elements 16, 18, 20 and 22 may be manufactured using fully or at least partially automated systems and/or methods according to the CAD models, as discussed below in greater detail.

Figure 2:
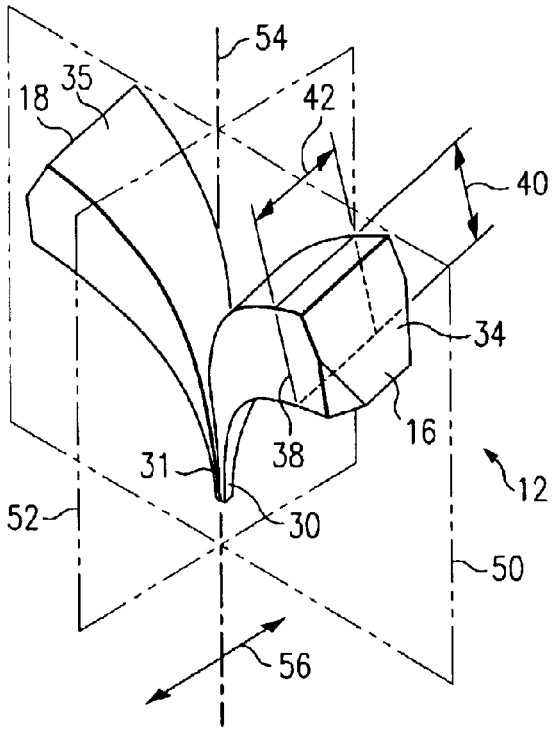
FIG. 2 illustrates a first radiator of the antenna of FIG. 1, including a first radiating element and a second radiating element.

FIG. 2 illustrates first radiator 12 of antenna 10 of FIG. 1, including first radiating element 16 and second radiating element 18. First radiating element 16 has a three-dimensional curved horn, or "alpine horn," shape having a cross-section that increases gradually from first end 30 to second end 34. In particular embodiments, first radiating element 16 has a substantially rectangular cross-section 38 having a width 40 and a thickness 42 both gradually increasing from first end 30 to second end 34. In some embodiments, the ratio of width 40 to thickness 42 remains substantially constant from first end 30 to second end 34 of first radiating element 16. In addition, in particular embodiments, such as the embodiment shown in FIG. 2, cross-section 38 is approximately square for at least a substantial portion of the length of first radiating element 16 from first end 30 to second end 34.

Second radiating element 18 may have a substantially similar, symmetrical, mirrored, or identical three-dimensional shape as that of first radiating element 16 such that radiating elements 16 and 18 work together to radiate an electromagnetic field. As shown in FIG. 2, first and second radiating elements 16 and 18 may be divided in half by first plane 50 and positioned symmetrically about second plane 52 orthogonal to first plane 50 such that first and second radiating elements 16 and 18 are substantially parallel to each other near the first ends 30 and 31 of radiating elements 16 and 18, respectively, and curve away from each other toward the second ends 34 and 35 of radiating elements 16 and 18, respectively.

As shown in FIG. 1, radiating elements 20 and 22 of radiator 14 may have a substantially similar, symmetrical, mirrored, or identical three-dimensional shape as that of radiating elements 16 and 18 of radiator 12. In addition, radiating elements 20 and 22 of radiator 14 may be divided in half by second plane 52 and positioned symmetrically about first plane 50 such that radiating elements 16, 18, 20 and 22 are disposed symmetrically around an axis 54 defined by the intersection of the first and second planes 50 and 52. In this embodiment, radiating elements 16, 18, 20 and 22 are disposed in a symmetrical circular pattern at ninety degrees relative to each other.

The shape and/or positioning of radiating elements 16, 18, 20 and 22 with respect to each other near input ends 31, 32, 33 and 34 of radiating elements 16, 18, 20 and 22, respectively, may be designed or selected for a particular input impedance and radiation field pattern of antenna 10.

Figure 3:
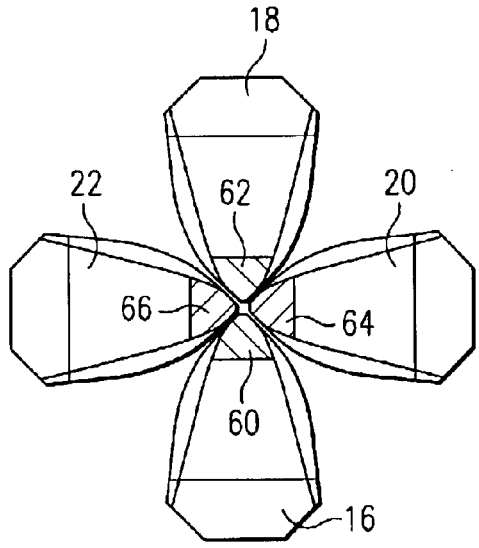
FIG. 3 is a top view of the antenna of FIG. 1 illustrating a cross-section of the antenna taken through plane A shown in FIG. 1.

FIG. 3 is a top view of antenna 10 illustrating a cross-section of antenna 10 taken through plane A shown in FIG. 1. In this example embodiment, plane A is orthogonal to axis 54 and passes through antenna 10 near input ends 31, 32, 33 and 34 of radiating elements 16, 18, 20 and 22, respectively. The cross-section of radiating elements 16, 18, 20 and 22 through plane A is illustrated by shaded regions 60, 62, 64 and 66 of radiating elements 16, 18, 20 and 22, respectively. In a particular embodiment, antenna 10 may be shaped and configuration as shown in FIG. 3 for a particular input impedance (such as an input impedance of 50 ohms, for example) and three-dimensional radiation field pattern.

As discussed above, in particular embodiments, each of first and second radiators 12 and 14 has a cross-section in the respective E-plane of each radiator 12 and 14 similar to that of traditional planar or two-dimensional flared notch radiators, but with a variable thickness in the direction orthogonal to the E-plane cross-section of each radiator 12 and 14. For example, radiator 12 has a cross-section taken through first plane 50 that is similar to a traditional planar or two-dimensional dipole flared notch radiator, but has a variable thickness in the direction indicated by arrow 56. Similarly, radiator 14 has a cross-section similar taken through second plane 52 that is similar to a traditional planar or two-dimensional dipole flared notch radiator, but has a variable thickness in the direction indicated by arrow 58. The varying thickness of radiator 12 orthogonal to the direction indicated by arrow 56 is designed in order to at least partially specify the radiation field pattern generated by radiator 12 in the direction indicated by arrow 56. Similarly, the varying thickness of radiator 14 orthogonal to the direction indicated by arrow 58 is designed in order to at least partially specify the radiation field pattern generated by radiator 14 in the direction indicated by arrow 58.

Thus, radiating elements 16 and 18 of first radiator 12 and radiating elements 20 and 22 of second radiator 14 are three-dimensional (in other words, the thickness of radiating elements 16, 18, 20 and 22 varies from the first end to the second end of the respective radiating element) such that the radiation field pattern generated by antenna 10 may be controlled in all three dimensions based on the shape of radiating elements 16, 18, 20 and 22 in all three dimensions. For example, the three-dimensional radiation field pattern generated by radiator 12 may be specified in the direction (indicated by arrow 56) orthogonal to first plane 50 in which radiator 12 generally lies based at least in part on the varying thickness of radiator 12 (in the direction indicated by arrow 56) from the first ends 30 and 31 to the second ends 34 and 35 of radiating elements 16 and 18, respectively. Similarly, the three-dimensional radiation field pattern generated by radiator 14 may be specified in the direction (indicated by arrow 58) orthogonal to first plane 52 in which radiator 14 generally lies based at least in part on the varying thickness of radiator 14 (in the direction indicated by arrow 58) from the first ends 32 and 33 to the second ends 36 and 37 of radiating elements 20 and 22, respectively.

Thus, the radiation field pattern associated with each radiator 12 and 14 can be influenced or controlled in all three dimensions by selecting or designing the shape in all three dimensions of the radiating elements associated with the respective radiator. In addition, in particular embodiments, such as the embodiment shown in FIG. 1, the shape and positioning of radiators 12 and 14 provides two orthogonal radiation sources having at least substantially identical "phase centers." Moreover, in particular embodiments, since the radiation field pattern of each of the two orthogonal radiation sources may be controlled substantially or nearly independently (for example, by selecting the three-dimensional shape of the radiating elements associated with radiators 12 and 14), a predictable and/or desired peak bore-sight gain may be provided.

By specifying the radiation field pattern transmitted by each radiator 12 and 14, and thus antenna 10, in all three dimensions, the scattering or dissipation of signals transmitted by antenna 10 may be reduced as compared with traditional planar or two-dimensional antennas. Thus, three-dimensional antennas as described herein, such as antenna 10, may produce a stronger or more focussed electromagnetic field from a particular input power as compared to traditional planar or two-dimensional antennas, particularly in the direction orthogonal to the plane in which each radiator of the antenna generally lies. As a result, less power may be required to produce a radiation field pattern having particular strengths at a particular points using three-dimensional antenna 10 than would be required using a traditional two-dimensional antenna. Thus, input energy to the antenna may be conserved, which may be particularly beneficial in limited power applications, such as onboard an aircraft, for example.

In some embodiments, radiating elements 16, 18, 20 and 22 are relatively massive structures such that antenna 10 may tolerate the heat associated with large $I^2R$ losses generated in high-power applications. For example, in a particular embodiment of antenna 10, radiating element 16 measures approximately 2.75 inches in the direction indicated by arrow 58, approximately 4.5 inches in the direction along axis 54, and a square cross-section 38 measuring 1.4 inches by 1.4 inches near the second end 32 of radiating element 16. The face near the second end of each radiating element 16, 18, 20 and 22 (for example, ends 32 and 36 of radiating elements 16 and 18, respectively) may be flat or have any other suitable shape. For example, as shown in FIGS. 1 and 2, the face near the second end of each radiating element 16, 18, 20 and 22 may include one or more notches or chamfers 44, which may be designed such that antenna 10 may be fit within a particular radome or other housing that imposes various size, area, or volume constraints, for example.

In addition, antenna 10 may be relatively efficient and stable in operation. For example, in one embodiment, the input impedance of antenna 10 approximately 50 ohms and well-behaved over a wide frequency range, such as a frequency range covering multiple octaves. Thus, antenna 10 may exhibit a relatively low and stable voltage standing wave ratio (VSWR) over a significantly wide frequency band.

The shape, dimensions, and configuration of radiating element 16, 18, 20 and 22 in all three dimensions may be selected based on the three-dimensional radiation field pattern associated with an antenna 10 comprising such radiating elements 16, 18, 20 and 22. In particular embodiments, computer aided design (CAD) software, such as PRO/ENGINEER and/or various electromagnetic simulation software packages, for example, may be used to model or simulate radiating elements, radiators and/or antennas (such as radiating element 16, 18, 20 and 22, radiators 12 and 14, and antenna 10) having various shapes, dimensions, and configurations. Such software may be used to determine the radiation field patterns associated with such modeled radiating elements, radiators and/or antennas. Thus, in some embodiments, a radiator and/or antenna may be designed to produce a radiation field pattern having one or more desired parameters, such as a particular three-dimensional signature, for example.

In particular embodiments, a radiator or antenna, such as radiator 12 or 14 or antenna 10, may be manufactured using one or more automated manufacturing systems or methods. For example, software such as CAD software may be used to generate files that define the shapes, volumes, dimensions, materials and/or configurations of modeled radiator elements, radiators or antennas. These files may then be used by automated manufacturing equipment to machine the surfaces of the modeled radiator elements, radiators or antennas according to the shapes, dimensions, materials and/or configurations specified by the files. For example, a five-axis milling machine may receive a PRO/ENGINEER file describing a modeled radiating element, generate an intermediate file including manufacturing instructions based on the PRO/ENGINEER file, and automatically machine the surfaces of the radiating element based on the instructions included in the intermediate file. Other suitable automated or at least partially automated manufacturing devices may be similarly used to physically machine or construct the radiating elements, radiators and/or antennas.

Radiating elements 16, 18, 20 and 22 may be formed from any one or more materials suitable for use in a radiating antenna. These may include materials that are substantially conductive and that are relatively easily to machine, cast and/or solder or braze. For example, one or more radiating elements 16, 18, 20 and 22 may be formed from copper, cast aluminum or brass. In some embodiments, one or more radiating elements 16, 18, 20 and 22 may be substantially or completely solid. For example, one or more radiating elements 16, 18, 20 and 22 may be formed from substantially solid copper, brass or aluminum. In other embodiments, one or more radiating elements 16, 18, 20 and 22 are substantially formed from some other material, such as plastic for example, and have an outer surface covered or plated with a suitable material, such as copper for example. In other embodiments, one or more radiating elements 16, 18, 20 and 22 may be substantially or completely hollow, or have some combination of solid and hollow portions. For example, one or more radiating elements 16, 18, 20 and 22 may include a number of planar sheet "cut-outs" that are soldered, brazed, welded or otherwise held together to form a hollow three-dimensional structure.

Figure 4:
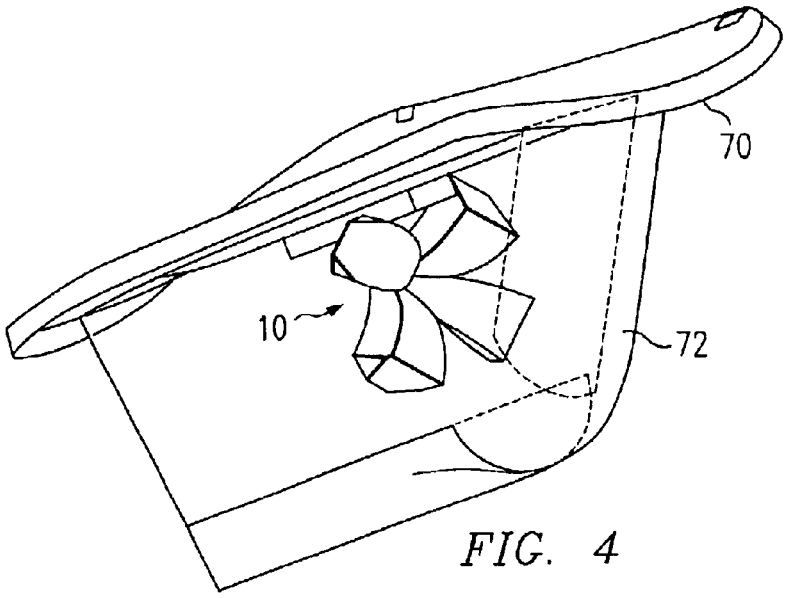
FIG. 4 illustrates a three-dimensional wideband antenna covered by a radome and mounted to an outer skin of an aircraft for use in radar applications in accordance with an embodiment of the present invention.

As previously discussed, three-dimensional antenna 10 may be used in radar applications. For example, in a particular embodiment, three-dimensional antenna 10 may be used on an aircraft for electronic warfare applications, such as to transmit appropriate signals to jam enemy radar. FIG. 4 illustrates an example antenna 10 mounted to an aircraft for use in such radar applications. Antenna 10 may be mounted to any suitable portion of an aircraft in any suitable manner, such as to an external surface of the aircraft or within a cavity in the aircraft. For example, as shown in FIG. 4, antenna 10 may be mounted to an external skin 70 of an aircraft. Antenna 10 may be at least partially covered or enclosed by a protective covering 72 operable to protect antenna 10 from dynamic air pressure, debris, or other airborne objects or particles and/or to reduce aerodynamic drag that may be produced by antenna 10. Protective covering 72 may include a radome, a solid housing, a cage, one or more flaps and/or baffles, absorbing septa, or any other covering suitable to protect antenna 10 and/or reduce aerodynamic drag associated with antenna 10.

In particular embodiments, radiating elements 16, 18, 20 and 22, may be structurally supported, or mounted, in a "cradle" or "nest" structure. For example, the nest structure may be machined or formed such that radiating elements 16, 18, 20 and 22 fit snugly within the cradle or nest, such as to hold the radiating elements firmly in position. The nest structure may be machined or formed from a variety of formable materials, such as Styrofoam, expanded polystyrene, or Rohacell. In particular embodiments, the nest structure may be formed using various "foamed-in-place" techniques. In addition, various radar-absorbing material may be embedded in the nest structure. Also, various collars, pillars and/or septa may be provided to support or control the position of radiating elements 16, 18, 20 and 22. In particular embodiments, such structures may be provided to enhance particular desirable radiation properties and/or to suppress particular undesirable radiation properties.

It should be understood that although radiators 12 and 14 are described above as components of antenna 10, in alternative embodiments, each radiators 12 or 14 may stand alone as an antenna. As discussed above, the three-dimensional radiation field patterns of such radiators 12 and 14 are specified in all three dimensions based on the three-dimensional shape of the respective radiator 12 or 14 in all three dimensions.

Figure 5:
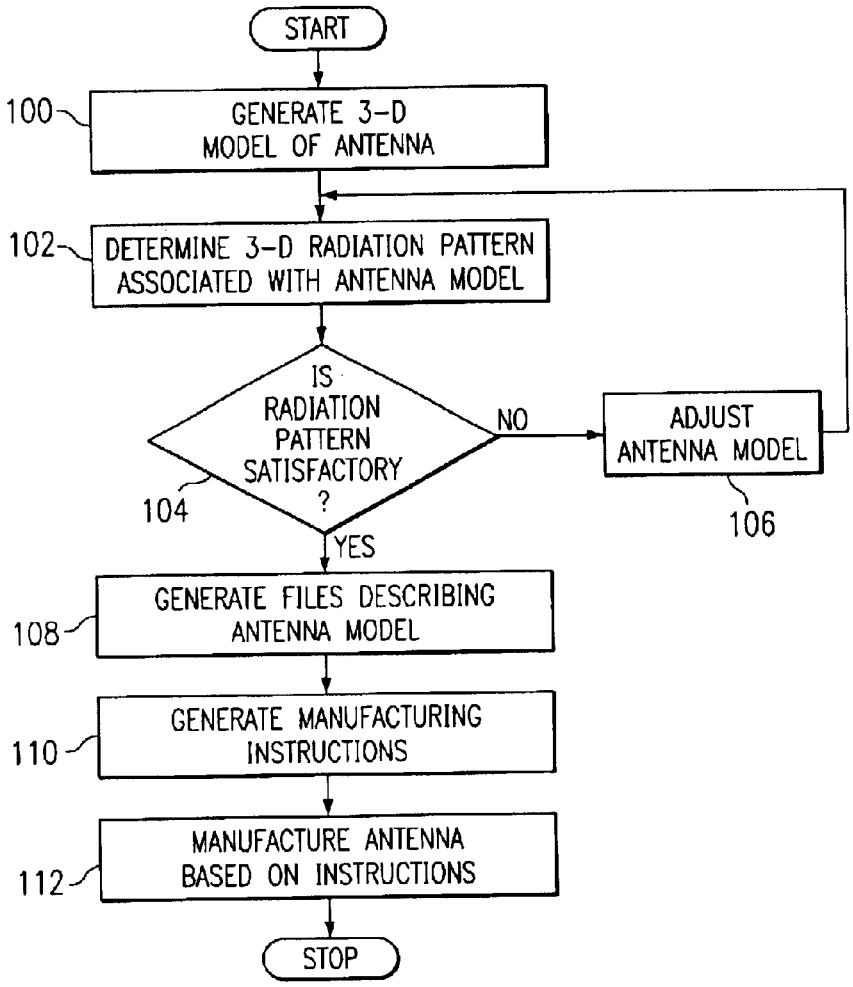
FIG. 5 illustrates a method of designing a three-dimensional antenna in accordance with an embodiment of the present invention.

FIG. 5 illustrates a method of designing a three-dimensional antenna in accordance with an embodiment of the present invention. At step 100, a model of an antenna comprising one or more radiators may be generated using CAD software, such as PRO/ENGINEER software, for example. Each radiator may comprise one or more three-dimensional radiating elements. For example, as discussed above, antenna 10 may comprise two radiators, each including a pair of radiating elements. The three-dimensional shape of each modeled radiating element may vary in each of the three dimensions. For example, one or more modeled radiating element may comprise a first end and a second end, and a cross-section having a width and a thickness that both vary from the first end to the second end of the respective radiating element.

At step 102, a three-dimensional radiation field pattern associated with the model antenna generated at step 100 may be determined, or predicted, using CAD software, such as electromagnetic CAD software. The shape of the three-dimensional radiation field pattern in each dimension is determined based at least in part on the( three-dimensional shape of each of the modeled radiating elements.

At step 104, it is determined whether the radiation field pattern predicted at step 102 is desirable or satisfactory. For example, it may be determined whether the radiation field pattern has a particular shape or signature in one or more dimensions or whether the radiation field pattern has a particular strength or focus at a particular point.

If it is determined at step 104 that the radiation field pattern associated with the modeled antenna is undesirable or unsatisfactory, one or more dimensions, absorbers, or other aspects of the equations defining the shape, surfaces, volume or configuration of the modeled antenna may be adjusted at step 106. For example, in an embodiment in which an antenna similar to antenna 10 is modeled, the cross-sectional shape of one or more radiating element 16, 18, 20 and 22 (such as cross-section 38 of radiating element 16, for example) may be adjusted to alter the resulting radiation field pattern of antenna 10 in one or more dimensions. The method may then return to step 102 to determine the three-dimensional radiation field pattern associated with the model antenna as adjusted at step 106. The method may then continue to step 104 to determine whether the radiation field pattern associated with the adjusted model antenna is desirable or satisfactory. Steps 106, 102 and 104 may be repeated until it is determined at step 104 that the radiation field pattern associated with the model antenna is desirable or satisfactory.

After it is determined at step 104 that the radiation field pattern associated with the model antenna is desirable or satisfactory, one or more files may be generated at step 108 that describe the shape, dimensions, materials and/or configurations of the model antenna. For example, such files may include files generated by the CAD software (such as PRO/ENGINEER files, for example).

At step 110, a set of computerized numerical control (CNC) manufacturing instructions for machining the elements of an antenna based on the model antenna may be generated based on the files generated at step 108. In particular embodiments, CNC instructions may be generated by fully or partially automated manufacturing equipment. For example, a five-axis milling machine may receive a PRO/ENGINEER file describing a model antenna and generate an intermediate file including manufacturing instructions based on the PRO/ENGINEER file.

At step 112, fully or partially automated manufacturing equipment may machine the antenna (or components of the antenna) according to the CNC instructions generated at step 110. For example, a five-axis milling machine may automatically manufacture the antenna based on the instructions included in an intermediate file generated at step 108. As discussed above, in particular embodiments, such manufacturing is completely or at least partially automated. For example, the manufacturing instructions generated at step 110 may be communicated to one or more automated manufacturing devices operable to manufacture the antenna, particular components of the antenna, or particular components of the supporting nest structure based on the manufacturing instructions, with little or no human assistance. The antenna or antenna components may be manufactured in various ways. For example, as discussed above, the antenna may include solid, hollow, cast, or plated portions and may be formed from one or more various materials.

Although an embodiment of the invention and its advantages are described in detail, a person skilled in the art could make various alternations, additions, and omissions without departing from the spirit and scope of the present invention as defined by the appended claims.

What is claimed is:

1. An antenna operable to radiate electromagnetic signals in a three-dimensional radiation field pattern, the antenna comprising:

one or more radiators, each radiator comprising one or more radiating elements;

each radiating element having a three-dimensional shape and comprising a first end, a second end, and a cross-section having a width and a thickness, wherein the width and thickness of the cross-section of each radiating element vary from the first end to the second end of the respective radiating element; and wherein the three-dimensional shape of each radiating element varies in each of the three dimensions.

2. The antenna of claim 1, wherein the three-dimensional shape of each radiating element is selected to define the three-dimensional radiation field pattern in each of the three dimensions.

3. The antenna of claim 1, wherein the cross-section of each radiating element from the first end to the second end of the respective radiating element is selected to define the three-dimensional radiation field pattern in each of the three dimensions.

4. The antenna of claim 1, wherein the one or more radiators comprise a pair of dual-polarized radiators positioned orthogonal to each other.

5. The antenna of claim 1, wherein the antenna is operable to radiate circular polarized signals.

6. The antenna of claim 1, wherein each radiator comprises a cross-section having a shape substantially similar to that of a planar flared notch radiator, and varies in thickness in a direction orthogonal to the cross-section from an input end to a flared end of the respective radiator.

7. The antenna of claim 1, wherein:

a first radiator of the one or more radiators comprises a first radiating element comprising a three-dimensional curved horn shape having a first end and a second end;

the cross-section of the first radiating element at a position between the first and second end comprises a width and a thickness; and the width and the thickness of the cross-section increase gradually from the first end to the second end.

8. The antenna of claim 7, wherein the cross-section of the first radiating element is a rectangle, and wherein the width and thickness of the rectangle are substantially similar.

9. The antenna of claim 7, wherein:

the first radiator comprises a second radiating element comprising a three-dimensional curved horn shape having a first end and a second end and at least substantially similar to the three-dimensional curved horn shape of the first radiating element; and the first and second radiating elements are disposed symmetrically about a first plane such that the first and second radiating elements are substantially parallel to each other near the first ends of the first and second radiating elements and curve away from each other near the second ends of the first and second radiating elements.

10. The antenna of claim 1, wherein at least one of the one or more radiating elements is substantially solid and formed from a conductive material.

11. The antenna of claim 1, wherein at least one of the one or more radiating elements comprises an outer surface plated with a substantially conductive material.

12. The antenna of claim 1, wherein at least one of the one or more radiating elements is substantially hollow.

13. A method of producing a three-dimensional radiation field pattern, comprising:

radiating electromagnetic signals from an antenna comprising:

one or more radiators, each radiator comprising one or more radiating elements;

each radiating element having a three-dimensional shape and comprising a first end, a second end, and a cross-section having a width and a thickness, wherein the width and thickness of the cross-section of each radiating element vary from the first end to the second end of the respective radiating element; and wherein the three-dimensional shape of each radiating element varies in each of the three dimensions.

14. The method of claim 13, wherein the three-dimensional shape of each radiating element is selected to define the three-dimensional radiation field pattern in each of the three dimensions.

15. The method of claim 13, wherein each radiator comprises a cross-section having a shape substantially similar to that of a planar flared notch radiator, and varies in thickness in a direction orthogonal to the cross-section from an input end to a flared end of the respective radiator.

16. The method of claim 13, wherein the one or more radiators comprise a pair of dual-polarized radiators positioned orthogonal to each other.

17. The method of claim 13, wherein radiating electromagnetic signals from an antenna comprises radiating circular polarized signals.

18. The method of claim 13, wherein:

a first radiator of the one or more radiators comprises a first radiating element comprising a three-dimensional curved horn shape having a first end and a second end;

the cross-section of the first radiating element at a position between the first and second end comprises a width and a thickness; and the width and the thickness of the cross-section increase gradually from the first end to the second end.

19. A method of designing an antenna, comprising:

generating, using computer aided design software, a model antenna comprising one or more radiators, each radiator comprising one or more radiating elements, each radiating element having a three-dimensional shape;

determining, using computer aided design software, a three-dimensional radiation field pattern associated with the model antenna, wherein the shape of the three-dimensional radiation field pattern is defined at least in part by the three-dimensional shape of each of the radiating elements;

determining whether the three-dimensional radiation field pattern associated with the model antenna is satisfactory; and if the three-dimensional radiation field pattern associated with the model antenna is not satisfactory, adjusting the three-dimensional shape of at least one of the one or more radiating elements.

20. The method of claim 19, further comprising:

generating computer instructions for manufacturing an antenna based on the model antenna; and manufacturing the antenna based on the generated computer instructions.

21. The method of claim 20, wherein the computer instructions for manufacturing the antenna are generated by the computer aided design software used to determine the three-dimensional radiation field pattern associated with the model antenna.

22. The method of claim 19, wherein generating a model antenna comprises generating a model antenna in which the three-dimensional shape of each radiating element varies in each of the three dimensions.

23. The method of claim 19, wherein generating a model antenna comprises generating a model antenna in which each radiating element comprises a first end, a second end, and a cross-section having a width and a thickness, and wherein the width and thickness of the cross-section of each radiating element varies from the first end to the second end of the respective radiating element.

24. The method of claim 23, wherein generating a model antenna comprises selecting the cross-section of each radiating element from the first end to the second end of the respective radiating element to define the three-dimensional radiation field pattern in each of the three dimensions.

25. The antenna of claim 19, wherein generating a model antenna comprising one or more radiators comprises generating a model antenna comprising one or more radiators, wherein each radiator comprises a cross-section having a shape substantially similar to that of a planar flared notch radiator, and varies in thickness in a direction orthogonal to the cross-section from an input end to a flared end of the respective radiator.

26. The method of claim 19, wherein generating a model antenna comprising one or more radiators includes generating a model antenna comprising a pair of dual-polarized radiators positioned orthogonal to each other.

27. The method of claim 19, wherein generating a model antenna comprising one or more radiators includes generating a model antenna operable to radiate circular polarized signals.

28. The method of claim 19, wherein generating a model antenna comprising one or more radiators comprises generating a model antenna comprising a first radiator including a first radiating element comprising a three-dimensional curved horn shape having a first end and a second end;

wherein the cross-section of the first radiating element at a position between the first and second end comprises a width and a thickness; and wherein the width and the thickness of the cross-section increase gradually from the first end to the second end.

29. The method of claim 28, wherein the cross-section of the first radiating element is a rectangle, and wherein the width and thickness of the rectangle are substantially similar.

* * * * *